US008415550B2

(12) United States Patent
Sullivan

(10) Patent No.: US 8,415,550 B2
(45) Date of Patent: Apr. 9, 2013

(54) SYSTEMS AND METHODS FOR A DIGITAL STRINGED INSTRUMENT

(75) Inventor: Daniel E. Sullivan, Shoreview, MN (US)

(73) Assignee: Zivix LLC, Minneapolis, MN (US)

( * ) Notice: Subject to any disclaimer, the term of this patent is extended or adjusted under 35 U.S.C. 154(b) by 0 days.

(21) Appl. No.: 13/456,429

(22) Filed: Apr. 26, 2012

(65) Prior Publication Data

US 2012/0210846 A1 Aug. 23, 2012

Related U.S. Application Data

(63) Continuation of application No. 12/246,865, filed on Oct. 7, 2008, now Pat. No. 8,173,887.

(51) Int. Cl.
*G10H 3/06* (2006.01)

(52) U.S. Cl. ..... 84/724

(58) Field of Classification Search ..... 84/724
See application file for complete search history.

(56) References Cited

U.S. PATENT DOCUMENTS

| | | | |
|---|---|---|---|
| 3,482,029 | A | 12/1969 | Sines |
| 3,694,559 | A | 9/1972 | Suzuki et al. |
| 3,786,167 | A | 1/1974 | Borell et al. |
| 3,960,044 | A | 6/1976 | Nagai et al. |
| 4,321,852 | A | 3/1982 | Young, Jr. |
| 4,339,979 | A | 7/1982 | Norman |
| 4,372,187 | A | 2/1983 | Berg |
| 4,468,997 | A | 9/1984 | Young, Jr. |
| 4,468,999 | A | 9/1984 | Bonanno |
| 4,580,479 | A | 4/1986 | Bonanno |
| 4,653,376 | A | 3/1987 | Allured et al. |
| 4,658,690 | A | 4/1987 | Aitken et al. |
| 4,730,530 | A | 3/1988 | Bonanno |
| 4,748,887 | A | 6/1988 | Marshall |
| 4,794,838 | A | 1/1989 | Corrigau, III |
| 4,815,353 | A | 3/1989 | Christian |
| 4,858,509 | A | 8/1989 | Marshall |
| 4,919,031 | A | 4/1990 | Matsumoto |
| 4,951,545 | A | 8/1990 | Yoshida |
| 4,966,053 | A | 10/1990 | Dornes |
| 5,010,800 | A | 4/1991 | Yoshida |
| 5,012,086 | A | 4/1991 | Barnard |
| 5,033,351 | A | 7/1991 | Nomura |

(Continued)

FOREIGN PATENT DOCUMENTS

| | | |
|---|---|---|
| JP | 04219794 | 8/1992 |
| JP | 04242796 | 8/1992 |

(Continued)

OTHER PUBLICATIONS

"U.S. Appl. No. 11/498,996, Final Office Action mailed Mar. 19, 2009", 17 pgs.

(Continued)

*Primary Examiner* — Jeffrey Donels
(74) *Attorney, Agent, or Firm* — Schwegman Lundberg & Woessner, P.A.

(57) ABSTRACT

Systems and methods for a digital instrument are described, for example to simulate or be used in conjunction with a stringed instrument. A sensor system detects the location of one or more fingers or objects at selected locations on a playing surface of the instrument, and the detected locations are combined with information indicative of one or more strings being played to generate a digital signal containing information as to the notes being played.

18 Claims, 9 Drawing Sheets

U.S. PATENT DOCUMENTS

| | | | |
|---|---|---|---|
| 5,033,353 | A | 7/1991 | Fala et al. |
| 5,040,447 | A | 8/1991 | Murata et al. |
| 5,140,887 | A | 8/1992 | Chapman |
| 5,140,890 | A | 8/1992 | Elion |
| 5,206,449 | A | 4/1993 | McClish |
| 5,214,232 | A | 5/1993 | Iijima et al. |
| 5,237,126 | A | 8/1993 | Curtis et al. |
| 5,396,025 | A | 3/1995 | Tamura |
| 5,398,585 | A | 3/1995 | Starr |
| 5,557,057 | A | 9/1996 | Starr |
| 5,739,455 | A | 4/1998 | Poon |
| 6,162,981 | A | 12/2000 | Newcomer et al. |
| 6,191,350 | B1 | 2/2001 | Okulov et al. |
| 6,610,917 | B2 | 8/2003 | Ludwig |
| 6,846,980 | B2 | 1/2005 | Okulov |
| 7,112,738 | B2 | 9/2006 | Hyakutake et al. |
| 7,223,913 | B2 | 5/2007 | Knapp et al. |
| 7,598,449 | B2 | 10/2009 | Sullivan |
| 7,671,269 | B1 | 3/2010 | Krueger et al. |
| 7,897,866 | B2 | 3/2011 | Sullivan |
| 8,022,288 | B2 | 9/2011 | Sullivan |
| 8,173,887 | B2 | 5/2012 | Sullivan |
| 2002/0005108 | A1 | 1/2002 | Ludwig |
| 2004/0200338 | A1 | 10/2004 | Pangrie |
| 2005/0183567 | A1 | 8/2005 | Aoki et al. |
| 2006/0107626 | A1 | 5/2006 | Wilson |
| 2006/0174756 | A1 | 8/2006 | Pangrle |
| 2007/0256551 | A1 | 11/2007 | Knapp et al. |
| 2008/0028920 | A1 | 2/2008 | Sullivan |
| 2008/0062402 | A1 | 3/2008 | Rouget et al. |
| 2008/0141847 | A1 | 6/2008 | Komatsu et al. |
| 2008/0282873 | A1 | 11/2008 | Kotton et al. |
| 2009/0308232 | A1 | 12/2009 | McMillen et al. |
| 2009/0314157 | A1 | 12/2009 | Sullivan |
| 2010/0083807 | A1 | 4/2010 | Sullivan |
| 2010/0083808 | A1 | 4/2010 | Sullivan |

FOREIGN PATENT DOCUMENTS

| | | | |
|---|---|---|---|
| WO | WO-2008019089 | A2 | 2/2008 |
| WO | WO-2008019089 | A3 | 2/2008 |
| WO | WO-2010042508 | A2 | 4/2010 |
| WO | WO-2010042508 | A3 | 4/2010 |

OTHER PUBLICATIONS

"U.S. Appl. No. 11/498,996, Non-Final Office Action mailed Mar. 26, 2008", 9 pgs.

"U.S. Appl. No. 11/498,996, Notice of Allowance mailed May 18, 2009", 4 pgs.

"U.S. Appl. No. 11/498,996, Response filed Apr. 22, 2009 to Final Office Action mailed Mar. 19, 2009", 12 pgs.

"U.S. Appl. No. 11/498,996, Response filed Jul. 28, 2008 to Non Final Office Action mailed Mar. 28, 2008", 65 pgs.

"U.S. Appl. No. 11/498,996, Response to Notice of Non-Compliant Amendment mailed Dec. 22, 2008", 23 pgs.

"U.S. Appl. No. 12/246,824, Non-Final Office Action mailed Jul. 6, 2010", 13 pgs.

"U.S. Appl. No. 12/246,824, Examiner Interview Summary mailed Sep. 22, 2010", 3 pgs.

"U.S. Appl. No. 12/246,824, Notice of Allowance mailed Oct. 29, 2010", 9 pgs.

"U.S. Appl. No. 12/246,824, Response filed Jun. 1, 2010 to Restriction Requirement mailed Apr. 29, 2010", 7 pgs.

"U.S. Appl. No. 12/246,824, Response filed Oct. 1, 2010 to Non Final Office Action mailed Jul. 6, 2010", 14 pgs.

"U.S. Appl. No. 12/246,824, Restriction Requirement mailed Apr. 29, 2010", 7 pgs.

"U.S. Appl. No. 12/246,850, Non-Final Office Action mailed Dec. 2, 2009", 11 pgs.

"U.S. Appl. No. 12/246,850, Response filed Sep. 21, 2009 to Restriction Requirement mailed Aug. 19, 2009", 9 pgs.

"U.S. Appl. No. 12/246,850, Restriction Requirement mailed Aug. 19, 2009", 6 pgs.

"U.S. Appl. No. 12/246,865, Non Final Office Action mailed Aug. 24, 2011", 6 pgs.

"U.S. Appl. No. 12/246,865, Notice of Allowance mailed Feb. 17, 2012", 7 pgs.

"U.S. Appl. No. 12/246,865, Response filed Nov. 18, 2011 to Non Final Office Action mailed Aug. 14, 2011", 14 pgs.

"U.S. Appl. No. 12/548,849, Non Final Office Action mailed Dec. 29, 2010", 6 pgs.

"U.S. Appl. No. 12/548,849, Notice of Allowance mailed May 13, 2011", 5 pgs.

"U.S. Appl. No. 12/548,849, Response filed Mar. 22, 2011 to Non Final Office Action mailed Dec. 29, 2010", 3 pgs.

"International Application Serial No. PCT/US07/17383, International Search Report mailed Mar. 7, 2008", 4 pgs.

"International Application Serial No. PCT/US2009/059687, International Preliminary Report on Patentability received May 6, 2011", 6 pgs.

"International Application Serial No. PCT/US2009/059687, Search Report and Written Opinion mailed Apr. 28, 2010", 11 pgs.

SYSTEMS AND METHODS FOR A DIGITAL STRINGED INSTRUMENT

CLAIM OF PRIORITY

This application is a continuation of and claims the benefit of priority under 35 U.S.C. §120 to U.S. patent application Ser. No. 12/246,865, filed on Oct. 7, 2008, which is hereby incorporated by reference herein in its entirety.

BACKGROUND

The electric guitar is fundamentally an analog instrument, and its electrical design has not changed appreciably over the last 50 years. With the advent of low-cost processing and computers, the ability to provide sophisticated musical interfaces has made exponential progress over the same time period. The advantages that this technology can bring to the music world is well established in the keyboard world, where pianos have been transformed from a purely mechanical instrument into sophisticated music generators capable of sounding like any other instrument. Costs have plummeted to where an electronic keyboard is available as an inexpensive consumer product. The same can not be said to be true in the guitar world.

One of the main reasons that guitars have not entered into the digital world to the extent that pianos have has to with the fact that piano keys can be thought of as switches, and so adapt well to a digital interface. In contrast, an electric guitar relies on the vibration of a metal string across an electromagnetic pickup in order to produce an analog signal.

There are existing guitars that convert this analog signal into a digital form that can then be used to interface to digital processors. The musical instrument digital interface (MIDI) is standard format in musical electronics, and there are a number of MIDI guitars currently available. However, these have some fundamental flaws that prevent the guitars from providing an authentic feel and sound to the musician.

The principal problem is that in order to convert from the analog form to a digital one, the frequency of the string must be determined, which takes some perceptible amount of time. This delay or latency is very distracting to a musician attempting to play the guitar since the audio feedback is delayed from the time the desired note is struck until the sound is heard. The problem gets worse with lower frequencies as the corresponding periods become longer. The fact that the amount of latency varies considerably across the guitar note spectrum is another aspect of this problem that requires adaptation on the part of the player.

In addition to the frequency, a MIDI note event also includes a parameter for velocity or volume. In a keyboard, this represents how fast, or how hard a key was struck. In existing digital guitar methods such as those described above, there are additional problems in accurately determining the volume of the note. There is again a finite time that must elapse before this determination can be made, which can cause additional delays on top of the frequency determination. Since both the frequency and the volume information have to be released together to form a MIDI code, the delay becomes the worst of both.

Both the volume and frequency determination of the note are also prone to many errors, because there are many overtones in a guitar signal that combine to make these processes difficult. For example, ambient noise pickup (typically 60 cycle "hum") or a variety of other factors may cause false notes.

Another problem with existing digital guitars is capturing certain expression nuances. For example, an important element of playing guitar is note bending, or changing the pitch of a note by stretching the guitar string after it is initially played. Since the pitch of the note is constantly changing, the problem of converting this in real time to a digital signal becomes impractical. Other expression nuances include hammer-ons, pull-offs, and producing vibrato.

In order to accomplish the goal of a digital interface without latency, some systems use the fret board of the guitar as a switch matrix input, similar to a keyboard. Various techniques have been employed to form a switch matrix. One is to actually install a series of push-button switches on the fingerboard. This approach does not use guitar strings and requires a substantial adaptation of playing style, without allowing for the capture of expression nuances.

Another technique that has been used takes advantage of the fact that the guitar strings are metal, and electrically conductive, as are the fret bars located on the guitar neck. As the strings are fretted by the player, a contact is made and can be read. It is necessary in this case to produce special fret bars that are separated into six segments in order to distinguish a unique contact when all strings are fretted across and a common bus is formed. This method is expensive to manufacture and is incapable of capturing expression nuances.

OVERVIEW OF THE DISCLOSURE

To solve these problems, a method that eliminates the need for frequency analysis and analog-to-digital conversion is required.

To that end, a digital guitar is described. According to various embodiments, the guitar eliminates latency problems described above, is cost-effective, does not require adaptation on the part of the musician, and captures the nuances of musical expression necessary to make a digital guitar similar to a normal guitar.

According to some embodiments, a non-contact sensor system that can be embedded into a conventional guitar fingerboard is described. The sensor may be accurate enough to detect a fingertip fretting a string to within a high degree of precision. In some embodiments, the sensor may be calibrated so as to allow for variations in manufacturing, the playing environment, and playing styles. According to certain embodiments, the sensors may be connected to a processing circuit in order to generate a signal indicative of the musician's finger locations.

According to another embodiment, a system is described for determining when a string has been played. In some embodiments, light emitting elements are provided under the strings and an array of photosensitive elements may be placed above the strings. Shadows may be detected to determine the movement or location of the strings. Data may be stored over time to map the locations of the strings and determine picks and/or strums, to determine finger bends, to determine a note volume, and other characteristics according to certain embodiments.

According to yet another embodiment, an alternative system is described for determining when a string has been played. In some embodiments, this system uses existing pickups in an electric guitar and determines when a signal is generated. The system may advantageously determine that one or more strings have been played without latency associated with frequency analysis. In some embodiments a separate pickup is used for each string in order to provide additional confirmation or accuracy. Some embodiments may comprise magnetic pickups, piezoelectric pickups, or a combination of magnetic and piezoelectric pickups.

According to some embodiments, a musical instrument is described that may be used as a game controller. The musical instrument may generate a digital signal that indicates the locations of a users fingers when they are used to play the instrument. The signal may also indicate when one or more strings or simulated strings have been played. The digital signal may be configured to be used by a video game or other computing system with an entertainment or learning application. The musical instrument configured to be used as a game controller may be operable as an instrument independent of an external computing system in some embodiments. For example, a control signal for a game system may be output via a wireless transmitter in an electric guitar and an analog signal may be output via a standard connector to a guitar amplifier.

According to some embodiments, a musical instrument is provided that is adapted to be used as a video game controller. The instrument comprises a body portion and a neck portion, the neck portion connected to the body portion at a first end and comprising a plurality of finger positions between the first end and a second end. A first string is strung from the body portion to the second end of the neck portion, and a first sensor module is located under the first string on the neck portion. The first sensor module corresponds to a first one of the plurality of finger positions and is configured to detect a finger at a location proximate the first string at the first finger position. The first sensor module is also configured to generate a first signal when the finger is detected at the first finger position. The instrument further comprises a string detection module located on the body portion proximate the first string. The string detection module is configured to determine whether the first string has been played and to generate a second signal when the first string has been played. The instrument further comprises a processing module configured to receive the first signal and the second signal. The processing module generates a digital signal corresponding to the first signal and the second signal and outputs the digital signal to an external computing system.

In another embodiment, a method of generating control signals for a computing system is described. The method comprises sensing the presence of one or more objects on or near one or more of a plurality of playing locations of a stringed musical instrument, and sensing when one or more strings of the stringed musical instrument are played. A digital signal indicative of the one or more played strings and the one or more playing locations corresponding to the presence of the one or more objects is generated.

In some embodiments, a musical instrument is described comprising a plurality of strings, means for sensing the presence of one or more fingers at one or more locations proximate a playing surface of the musical instrument, and means for determining when one or more of the strings has been played.

In some embodiments, an electronic stringed instrument is disclosed. The electronic stringed instrument comprises a body portion having a bridge, a neck portion having a lower end connected to the body portion and an upper end, and a plurality of strings attached to the body portion near the bridge and to the neck portion near the upper end. The instrument further comprises a sensor board located on the neck portion underneath the strings. The sensor board includes a plurality of IR-transceiver/receiver modules located underneath an IR-transparent surface. The instrument also includes a string detection module located on the body portion. The string detection module comprises a light-emitting element and an array of photosensitive elements, wherein the strings pass substantially between the light-emitting element and the array.

This section is intended to provide an overview of subject matter of the present patent application. It is not intended to provide an exclusive or exhaustive explanation of the invention. The detailed description is included to provide further information about the present patent application.

BRIEF DESCRIPTION OF THE FIGURES

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
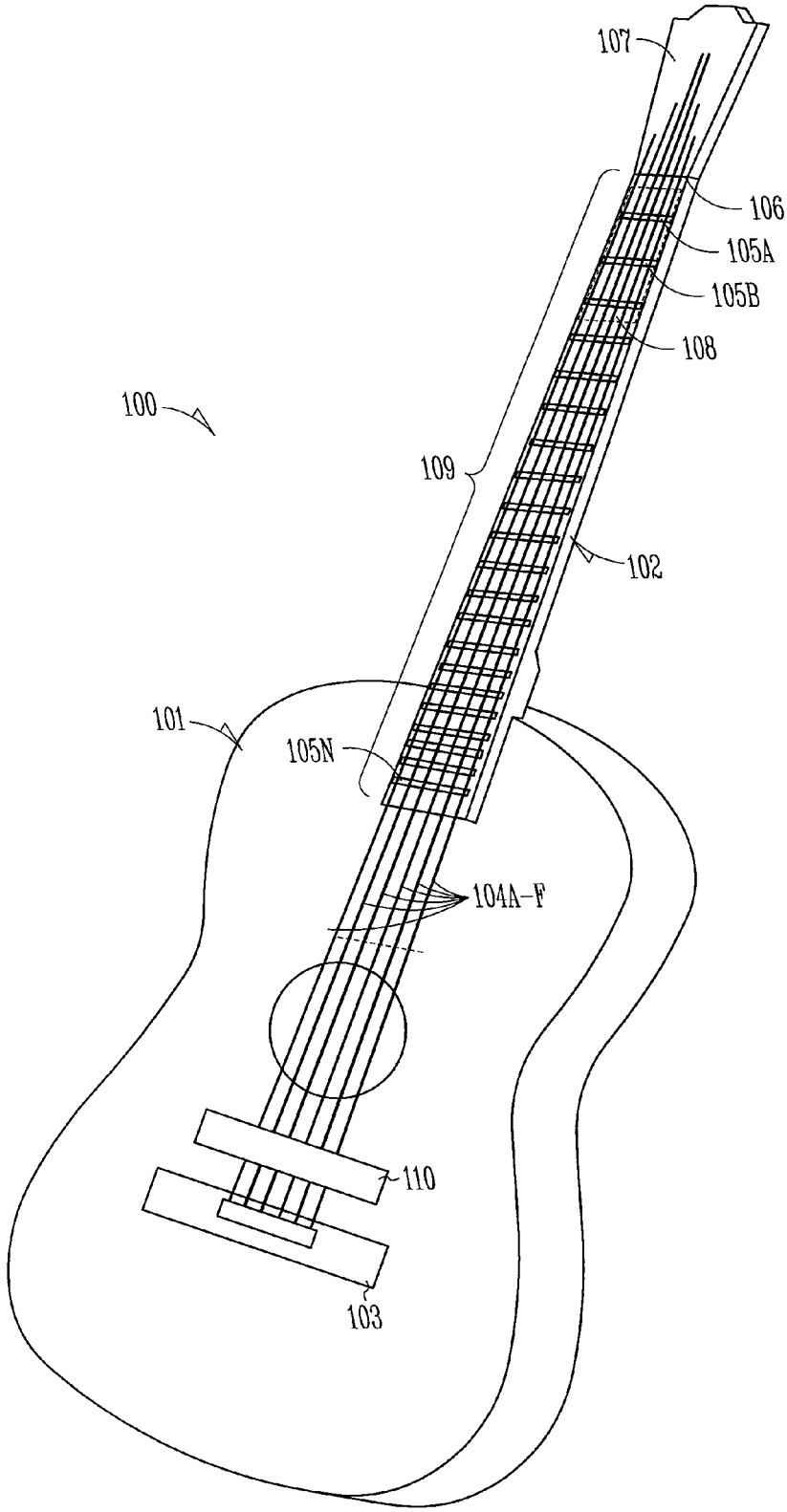
FIG. 1 illustrates a musical instrument according to one embodiment.

In the following detailed description, reference is made to the accompanying drawings which form a part hereof, and in which is shown, by way of illustration, specific embodiments in which the invention may be practiced. In the drawings, which are not necessarily drawn to scale, like numerals describe substantially similar components throughout the several views. The drawings illustrate generally, by way of example, but not by way of limitation, various embodiments discussed in the present document. These embodiments are described in sufficient detail to enable those skilled in the art to practice the invention. Other embodiments may be utilized and structural, logical, electrical changes, etc. may be made without departing from the scope of the present invention.

Various systems and methods for a digital guitar are described herein. The digital guitar may appear and play nearly identically to a standard guitar. However, the digital guitar may provide a digital output rather than a standard analog output provided by an electric guitar or by an acoustic guitar using an embedded pickup in the sound box.

Unlike previous attempts at creating a digital guitar, certain embodiments allow for the generation of a digital signal representative of the notes being played without noticeable latency that results from frequency analysis of the standard analog output signal. The digital guitar described herein may allow for the determination of where each string is being fretted based on detecting the locations of the musician's fingers. The digital guitar may also determine what expression nuances are modifying notes being played. According to some aspects of the disclosure, the digital guitar may detect which strings are being played and a volume associated with each string. The digital guitar may combine information about which strings are being played with information about which strings are being fretted to generate a digital output.

In certain embodiments, a digital interface for guitars may be used with, for example, educational or game-related software or systems. With certain systems and methods described herein, it is possible for an external program to determine the finger positions prior to actually plucking the string and for the player to see right away if the correct note has been played. This may be advantageous in learning applications or remote learning, where the proper chord position can be read before it is actually strummed.

In some embodiments, a digital guitar allows for the relatively inexpensive construction of an instrument that may be played in a similar manner to an existing instrument, while allowing nearly infinite variations. More advantages and novel aspects will be described below with reference to the drawings.

FIG. 1 shows a musical instrument 100. The instrument 100 is an acoustic guitar in the embodiment shown, but aspects of the disclosure are applicable to other instruments as well. For example, the Instrument 100 could alternatively comprise an electric guitar, a cello, a violin, or some other musical instrument.

The instrument 100 comprises a body portion 101 and a neck portion 102. One end of the neck 102 is connected to the body portion 101 and an opposite end of the neck 102 has a headstock portion 107.

In FIG. 1, six strings 104A-F are shown strung between a bridge 103 on the body portion 101 and the headstock 107 at the opposite end of the neck portion 102. The strings 104 vibrate between the bridge 103 and the nut 106 when the strings 104 are picked, strummed, or the like. In some embodiments, the strings 104 may be replaced with one or more simulated strings. For example, a button, lever, or switch may be used to simulate strumming one or more strings. The instrument 100 is shown as an acoustic guitar, and no pickups are shown. Nonetheless, pickups may be used with an acoustic guitar in accordance with certain embodiments, such as one or more piezoelectric pickups. In embodiments where the instrument 100 comprises an electric guitar, multiple pickups may be utilized. For example, multiple magnetic or piezoelectric pickups may be located proximate each string.

The top of the neck 102 comprises a fingerboard or fret board 109. In some embodiments, the fingerboard 109 extends onto the body portion 101. The fingerboard 109 as shown comprises a number of frets 105A-N. An acoustic guitar typically has nineteen frets 105 (not all shown in this view), while an electric guitar typically has between twenty-one and twenty-four frets. Different numbers of frets may be present according to some embodiments, depending in part on the instrument. In some embodiments, no frets are present.

In the embodiment shown, those frets 105 located nearest the nut 106 may be spaced further apart than the frets 105 located further down the fret board 109. For example, the distance between the nut 106 and the first fret 105A is approximately 1.059 times longer than the distance between the first fret 105A and the second fret 105B. In general, the ratio of the spacing between successive frets is approximately 1.059:1 in order to correlate the frets with musical half-steps. In other embodiments any spacing between frets may be used, including an equal spacing between frets.

The instrument 100 comprises a system 110 for detecting the movement and/or location of the strings 104A-F in the embodiment shown. The system 110 may advantageously generate a signal indicative of the movement of one or more of the strings 104A-F in some embodiments without noticeable latency. For example, the signal may indicate that one or more strings have been played, a volume of one or more notes being played, and other characteristics as will be described in more detail below.

In the example shown, the system 110 is mounted on the body portion 101 near the bridge 103. In other embodiments, the system 110 is mounted at any location such that at least one of the strings 104 is detected by the system 110.

The instrument 100 also comprises a sensor board 108 according to some embodiments. The sensor board or system 108 may advantageously allow for the detection of the musician's finger locations. This information may be used to generate a digital signal indicative of the notes to be played without performing frequency analysis which takes a noticeable amount of time. The sensor board 108 detects the approach or touch of one or more fingers, and generates a signal indicative of the location of those finger presses and/or approaches. The sensor board 108 may also be configured to detect certain variations or movements of the musician's fingers as the instrument 100 is played in order to add musical expression nuances, as will be described in more detail below. Reference is made throughout the application to fingers. While fingers are typically used, other objects may also be utilized such as a finger glide bar or a capo.

The sensor board 108 may be mounted on the fingerboard 109 in some embodiments. In some embodiments, the sensor board 108 may be built into the neck 102. The sensor board 108 is shown in FIG. 1 located between the nut 106 and the fifth fret 105E. However, the sensor board 108 may run across any number of frets 105. The sensor board 108 is also shown as being approximately equal to the width of the neck 102 and therefore crossing each of the strings 104A-F. In other embodiments, the sensor board 108 is the located under just one string 104, or under some other number of strings.

In some embodiments, certain frets may actually be part of the sensor board 108. For example, in the embodiment shown in FIG. 1, Frets 105A-E may be part of the sensor board 108. In other embodiments, the sensor board 108 is configured to fit between frets 105. In still other embodiments, no frets are present.

Figure 2:
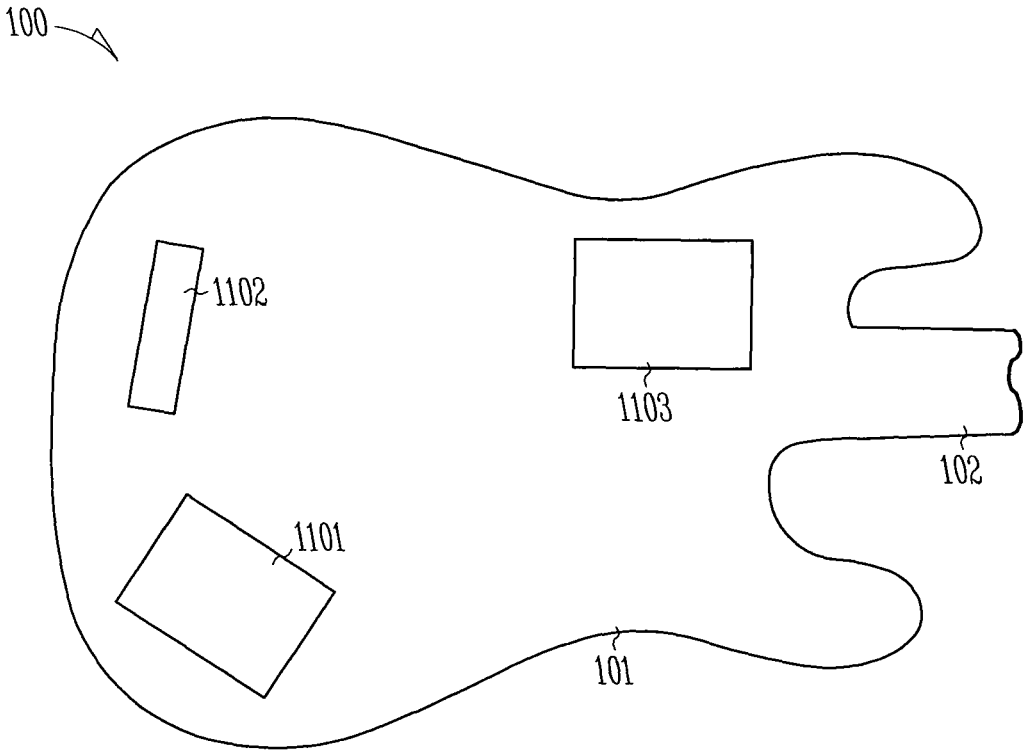
FIG. 2 illustrates a block diagram of certain electrical components of a musical instrument according to one embodiment.

FIG. 2 shows a simplified block diagram of a guitar 100 according to certain embodiments. The guitar 100 is an electric guitar and comprises a body portion 101 in which a number of components may be embedded according to certain embodiments. In the example shown, the guitar 100 comprises a main board 1103, batteries 1101, and a wireless transmitter or output module 1102.

The main board 1103 comprises a processor and an analog-to-digital convertor. The processor may comprise a general purpose microprocessor, application specific logic devices, or the like. The main board 1103 may also comprise a storage device, such as a hard drive, flash memory, or the like. The storage device may comprise a volatile memory, a non-volatile memory, or a combination of the volatile and non-volatile memory devices.

The main board receives analog signals from the sensor board 108 and from the system 110 in some embodiments, which may be passed through the analog-to-digital convertor and to the processor. The processor may be configured to determine based on the received data finger locations, strings being played, volume levels, expression nuances being used, and the like. In some embodiments the data or the information determined from the data may be stored in the storage device. The stored data may be accessed at a later time by the processor for calibration purposes, for calculations requiring an analysis of positions over time, or the like. The processor is also configured in some embodiments to generate an instruction or data signal indicative of the detected data and the notes being played.

The batteries 1101 provide power to the circuitry described herein. In some embodiments the batteries 1101 are removable and comprise readily available batteries such as four AA batteries. In other embodiments the batteries 1101 may comprise a rechargeable battery pack. In still other embodiments batteries are not used and an AC/DC converter is used with a standard wall plug to provide wired power.

The output module 1102 comprises circuitry for outputting signals generated by the processor 1103. The output module 1102 is preferably a wireless transceiver. In other embodiments, the output module 1102 comprises a ¼ inch TS connector input jack. In some embodiments a stereo ¼ TRS jack is used in place of the standard mono jack. The center conductor may be used to pass digital data from the guitar, such as MIDI information. Another of the conductors may be used to transmit, for example, an analog signal to a guitar amplifier such that the instrument can also be played normally. Any other connector, such as a USB connector, may be used in other embodiments. The output module 1102 may be configured to receive output signals from the processor 1103 and broadcast the output signals to, for example, a nearby computer or gaming system.

Figure 12:
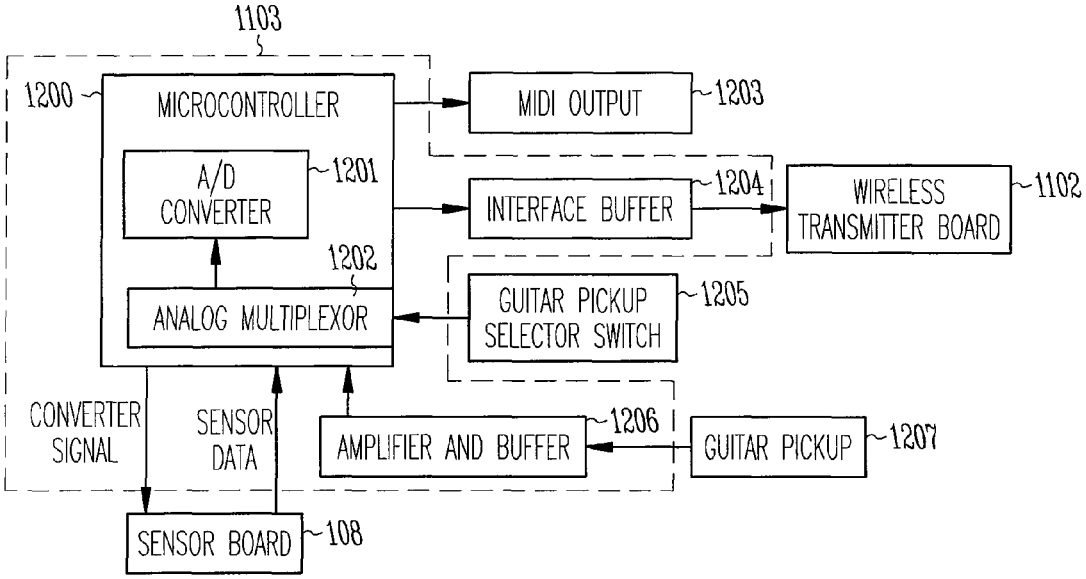
FIG. 12 illustrates a block diagram of certain components of a digital musical instrument according to one embodiment.

A simplified block diagram of the circuitry of the musical instrument 100 according to one embodiment is illustrated in FIG. 12. Components of the main board 1103 are connected to various systems, inputs, and outputs of the musical instrument 100. Certain components in FIG. 12 are shown on the main board 1103 or as part of the microcontroller 1200. In other embodiments, the components and modules shown in FIG. 12 may be combined into a single integrated circuit, comprise separate circuits, be located at locations other than the main board 1103, or the like. In some embodiments, certain components and modules may be added, replaced, or omitted.

In the example shown, the sensor board 108 is connected to the main board 1103. The sensor board 108 receives control signals, for example clock signals, from the microcontroller 1200 on the main board 1103. The sensor board outputs sensor data to the microcontroller 1200. Analog sensor data is provided to the analog-to-digital converter 1201 via the analog multiplexer 1202 of the microcontroller 1200 in the example shown.

The microcontroller 1200 outputs the control signals to the sensor board and receives the sensor data. The microcontroller 1200 further processes the sensor data and generates a digital signal corresponding to detected finger positions.

The microcontroller 1200 may further receive signals from guitar pickups 1207 via amplifier and buffer 1206. The guitar pickups 1207 may comprise any type of magnetic pickup, piezoelectric pickups, or the like. The guitar pickups 1207 are located proximate the strings and detect the movement and vibration of the strings. In some embodiments, one or more pickups are utilized for each string.

The microcontroller 1200 may process signals received from the guitar pickups 1207 through the analog multiplexor 1202 and the analog-to-digital converter 1201. The pickup signals may be processed to determine, for example, which if any of the strings of the guitar are being played. In some embodiments, the signals received from the guitar pickups 1207 may also be processed to determine a volume associated with one or more strings being played.

The microcontroller 1200 may utilize the processed guitar pickup signals in conjunction with the processed sensor board signals in generating an output signal. For example, the guitar pickup signal may be utilized in determining which strings have been played and at what volume, while the sensor board signal may be used to determine the note produced by each string.

In certain other embodiments, the guitar pickups 1207 may be replaced or used in conjunction with another system. For example, the guitar pickups 1207 may be replaced with one or more switches that may be activated to simulate playing one or more strings. A switch may then provide a signal to the microcontroller 1200 when it is played. In another embodiment, the guitar pickups 1207 are replaced by or used in combination with a sensor array that detects the movement of the strings using a light projection and detection system. Certain embodiments of such a sensor array are described in more detail below. The microcontroller 1200 may advantageously use information detected by the sensor array in conjunction with the information received from the sensor system 108. For example, in measuring string bend, the amount that the note should be altered may depend on where it is being fretted. This may also be true of velocity detection. Having the information from both systems may make the calculation of the string bend, volume, or the like more accurate and effective.

A guitar pickup switch selector 1205 may also be connected to the microcontroller 1200. The switch selector 1205 may comprise, for example, a three- or five-position blade switch, a three-way toggle switch, or the like. One of the positions may be connected to the microcontroller 1200 in order to activate certain wireless codes, for example for use with a video game.

The main board 1103 further comprises a MIDI output module 1203. For example, MIDI output module 1203 may be connected to the standard output jack of the guitar 100. For example, the output jack may comprise a ¼-inch IS connector jack. In certain embodiments, the standard connector jack is replaced with a ¼-inch stereo TRS connector jack or some other stereo connector, and the MIDI output module is configured to output a MIDI signal across one of the conductors of the stereo connector. The other conductors may be utilized, for example, for an analog output signal from the guitar pickups and a ground.

The microcontroller 1200 may also output digital signals indicative of the playing of the guitar via a wireless transmitter board 1102 connected via an interface buffer 1204. The interface buffer 1204 may simulate a dry contact closure with the transmitter board 1102. The wireless transmitter board 1102 may transmit a digital output signal to an external device. For example, the microcontroller 1200 may output a MIDI signal to the wireless transmitter 1102 via the interface buffer 1204. The wireless transmitter 1102 may broadcast this MIDI signal to an external computer. In other embodiments, a game control signal may be generated by the microcontroller 1200 and broadcast to an external video game system by the wireless transmitter 1102.

Sensor Board

Figure 3A:
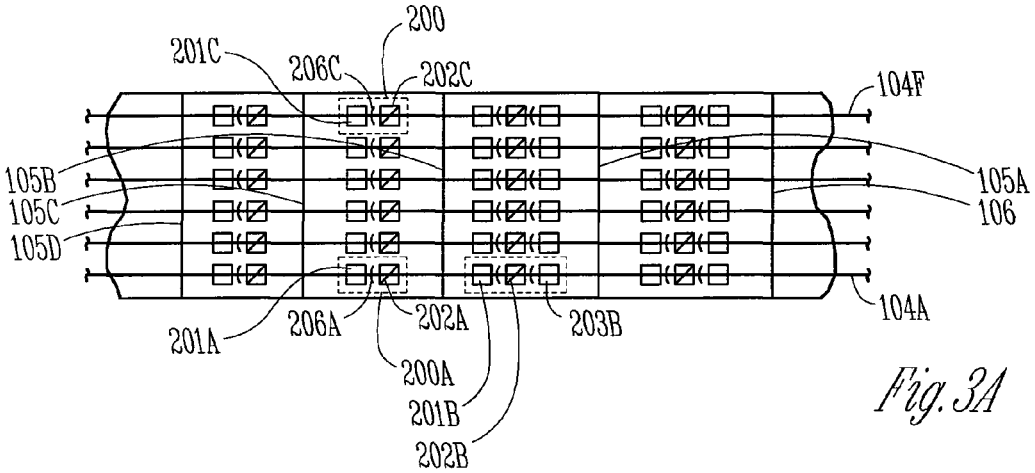
FIGS. 3A and 3B illustrate a fingertip sensor board according to different embodiments.

FIG. 3A shows a top-down view of one embodiment of the sensor board 108 on the neck 102 of the instrument 100. A portion of the sensor board 108 is shown extending from the nut 106 to the fourth fret 105D, but in different embodiments the sensor board 108 may extend across any number of frets 105 along the fingerboard 109. While the sensor board 108 is shown located next to the nut 106, the sensor board 108 may be located at a lower fret 105. The strings 104A-F are strung over the sensor board 108, although a center portion of the strings 104A and 104F is not shown in FIG. 3A in order to more clearly show certain aspects of the sensor board 108.

The sensor board 108 comprises a number of sensor modules 200. The sensor modules 200 detect the presence of a finger or object on or near the surface 204 of the sensor board 108. The sensor modules 200 are shown comprising at least a transmitter 202, a receiver 201, and a barrier 206.

The transmitter 202 generates light in a generally upward direction towards the surface 204 of the sensor board 108. The transmitter 202 may comprise, for example, a light emitting diode (LED). In some embodiments, the transmitter 202 comprises an infrared (IR) LED that emits light having a wavelength between about 700 nm and 1 mm. In other embodiments the transmitter 202 emits visible light.

The receiver 201 is also directed generally upwards and detects reflected or diffused light. The receiver 201 comprises, for example, a phototransistor that generates a current corresponding to the level of detected light. This current can then be converted into a voltage which in turn is converted via an analog-to-digital converter for use in a microprocessor-based algorithm. The receiver 201 comprises an IR sensitive phototransistor in some embodiments. The receiver 201 may be sensitive to both visible and IR light in some embodiments.

In a preferred embodiment, the sensor modules 200 operate using IR wavelengths. While IR reflection is a common and well-understood technique for non-contact object sensing through the measurement of a light reflection from a nearby object, the sensor may also work in a different way in certain embodiments. In experimenting with the suitability of sensors for use in detecting a fingertip it was found that while reflectivity from an approaching fingertip plays a role in deducing its location, the primary advantage of this method comes from the fact that the fingertip absorbs light above a certain wavelength and diffuses this light throughout the fingertip area. Infrared light is particularly well-suited to this effect.

An advantage of reading the light that is suffused throughout the fingertip is that the reading becomes greater in a favorable non-linear way as the fingertip approaches the maximum reading, which is the fingertip placed directly on the transmitter and receiver. This may not be the case in a reflected-light system, since the reflected light is blocked when the receiver is covered. This fact has been verified by experimenting with different light frequencies that the fingertip does not absorb, such as light from a blue LED. Using a blue LED and a phototransistor that is sensitive to the visible spectrum, it was found that a fingertip covering the transmitter and receiver has a minimum reading. Because precise fingertip detection is essential in a musical instrument such as a guitar, this method of reading light diffused throughout the fingertip is an important advantage.

Thus, while some existing instruments use IR light to modify a performance, certain embodiments discussed herein allow for very accurate, reliable, and repeatable detection of a finger or object in order to determine a note to be played. For example, the sensor modules described can detect the presence of a finger or object within approximately one inch or more of the playing surface, and can accurately determine the distance of the finger or object to within approximately 0.1 inches or less. The accuracy of the system, coupled with distinct playing areas on a firm playing surface in some embodiments, allows for the repeated and accurate activation of particular notes. This accuracy and repeatability is advantageous in replicating the playing of a standard guitar, which has many distinct note locations. The accuracy provided by the system also advantageously allows for the detection of slight variations in some embodiments, as described in more detail below.

In some embodiments, the receiver 201 and transmitter 202 may be located approximately 5 millimeters apart. In other embodiments the receiver 201 and transmitter 202 may be separated by some other distance. The barrier 206 may be located between the transmitter 202 and the receiver 201 in order to substantially prevent leakage and false reflections of light from the receiver 201.

As shown in FIG. 3A, sensor modules 200 may comprise additional receivers 203 in some embodiments. In some embodiments the additional receivers 203 may be substantially identical to the receivers 201. The additional receivers 203 may allow for improved detection over relatively large areas, as will be described in more detail below.

The sensor modules 200 are shown arranged in a grid-like fashion in FIG. 3A. Specifically, the sensor modules 200 are shown located along a particular string 104A-F and between frets 105. For example, the sensor module 200A is located along the string 104F and between the second fret 10513 and the third fret 105C. The sensor module 200B is located along the same string 104F, however it is located between the first fret 105A and the second fret 105B, closer to the nut 106 and the end of the neck 102. The sensor module 200C is located along a different string 104A, but between the same frets 105B and 105C as the sensor module 200A.

In many stringed instruments, the distance between frets or between musical half-steps decreases according to a constant proportion. Although FIG. 3A is not to scale, the distance between the first fret 105A and the second fret 105B is greater than the distance between the second fret 105B and the third fret 105C. The sensor module 200B is shown comprising an additional receiver 203 in order more accurately determine the location of a finger press or the like over the larger surface area defined by the frets 105A and 105B. In some embodiments, the first seven frets correspond to sensor modules 200 having additional receivers 203.

In FIG. 3A, sensor modules 200 are shown for each fret 105 and string 104 combination. In some embodiments, only selected strings 104 or frets 105 correspond to sensor modules 200. For example, the sensor hoard 108 may comprise live sensor modules 200 located along a single string 104 for time consecutive frets 105. In another example, each of six sensor modules 200 correspond to one of six strings 104A-F for a single fret 105. In still another example, thirty sensor modules 200 are located along six strings 104A-F for the frets 105 A-E, with each of the sensor modules 200 corresponding to a unique fret and string combination. In still another embodiment, every fret and string combination of the instrument corresponds to a sensor module 200.

Figure 3B:
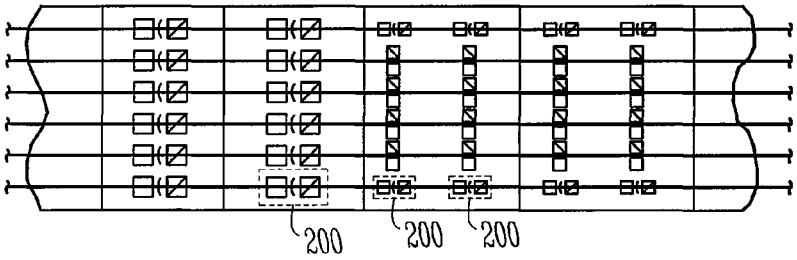

FIG. 3B shows a top-down view of the sensor board 108 according to another embodiment. In FIG. 3B, similar components are present when compared with FIG. 3A. However, as shown in FIG. 3A, the components are arranged slightly differently. Specifically, for the region between the nut 106 and the first fret 105A, and for the region between the first fret 105A and the second fret 105B, multiple sensor modules 200 are used to detect finger presses over the relatively large area. This is in contrast to the arrangement shown in FIG. 3A, wherein a single sensor module 200 having an additional receiver 203 was used for these areas. Additionally, some of the sensor modules 200 in FIG. 3B are shown rotated 90 degrees from their orientation in FIG. 3A.

Figure 4:
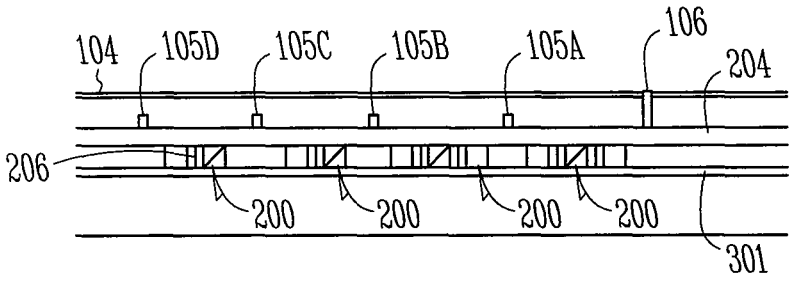
FIG. 4 illustrates a fingertip sensor board according to one embodiment.

FIG. 4 shows a side view of the sensor board 108 according to an embodiment. A portion of the sensor board 108 is shown spanning our frets 105A-D, but the sensor board 108 may span any number of frets 105.

The sensor board 108 comprises a number of sensor modules 200, as described above with reference to FIG. 3A. In FIG. 4, only the sensor modules 200 located under a single string 104 are shown. The sensor modules 200 are shown spanning four frets 105A-D.

A surface 204 is located on top of the sensor modules 200 and below the string 104. The sensors may be located underneath a surface 204 since in a musical instrument such as a guitar there needs to be a firm surface on which to press the strings. The surface 204 comprises a substantially flat surface in the embodiment shown. In some embodiments, the surface 204 is sized to either fit or replicate a standard fingerboard of a musical instrument, which may be slightly curved or have some other shape. The frets 105A-D are located on the surface 204 and are part of the sensor board 108 in the embodiments shown. In some embodiments no frets 105 are located on the surface 204.

In the case of IR sensor modules 200, the surface 204 is advantageously constructed of IR-transparent material. The material may be opaque to visible light for aesthetic reasons. Placing a surface 204 above the sensor pair may produce some amount of reflection. This is accommodated for in part through a calibration method as described in the calibration section. In addition, the surface 204 may be attached to a form that fits between the transmitters 202 and the receivers 201, forming the barriers 206. In some embodiments, this barrier layer 206 of the surface 204 is made of a material different than that of the top layer and is preferably opaque to both visible light and IR light.

The sensor modules 200 are located on and connected to a circuit board 301. Wiring and other electronic components are not shown on circuit board 301 in FIG. 4. The circuit board 301 may comprise a flexible circuit board in some embodiments. In some embodiments the circuit board 301 connects the sensor modules 200 with the main board 1103 that transforms the signals generated by the sensor modules 200 into an output signal indicative of which notes are being played on the instrument 100.

Figure 5:
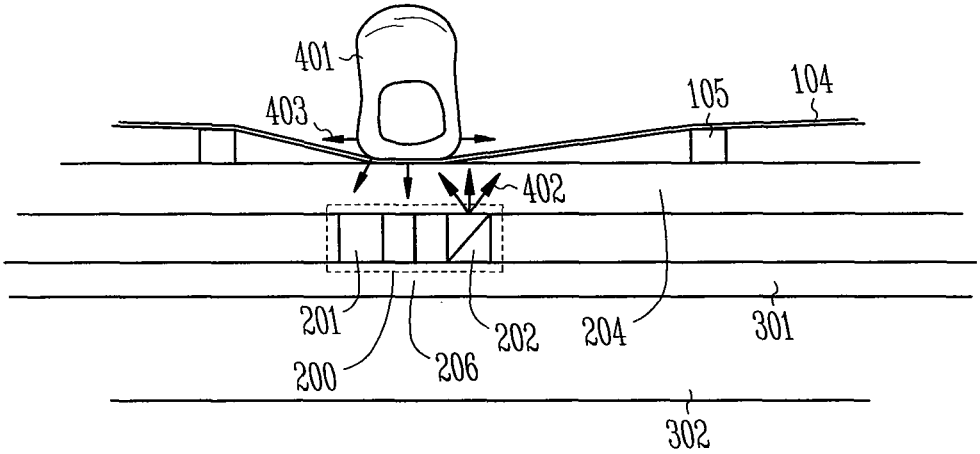
FIG. 5 illustrates a fingertip sensor board according to one embodiment.

FIG. 5 shows a sensor module 200 when a finger 401 approaches or comes in contact with the surface 204. In operation, light 402 from the transmitter 202 of sensor module 200 is directed through the surface 204. When a finger 401 or other object approaches the surface 204 at a location corresponding to the sensor module 200, the light is diffused or reflected by the approaching finger 401 or the other object. Some of the diffused or reflected light is directed downwards through the surface 204 and towards the sensor module 200. The amount of light diffused or reflected back towards the sensor module 200 is generally related to the distance of the object from the sensor module 200 and the composition of the object approaching the surface 204. The receiver 201 (and in some embodiments additional receiver 203) generates a current proportional to the amount of light that is diffused or reflected back towards the sensor module 200.

It is advantageous for cost reasons to minimize the number of wires that connect the main board 1103 to the fingerboard. Accordingly, the fingerboard may use a serial interface to communicate with the main board 1103. In some embodiments, the receiver 201 is therefore read as the associated transmitter 202 is strobed on. The transmitters 202 may be strobed one at a time, for example at a frequency of approximately 8 MHz or some other frequency. When there is an array of both transmitters 202 and receivers 201, it is advantageous to multiplex the operation of reading the array.

Figure 6:
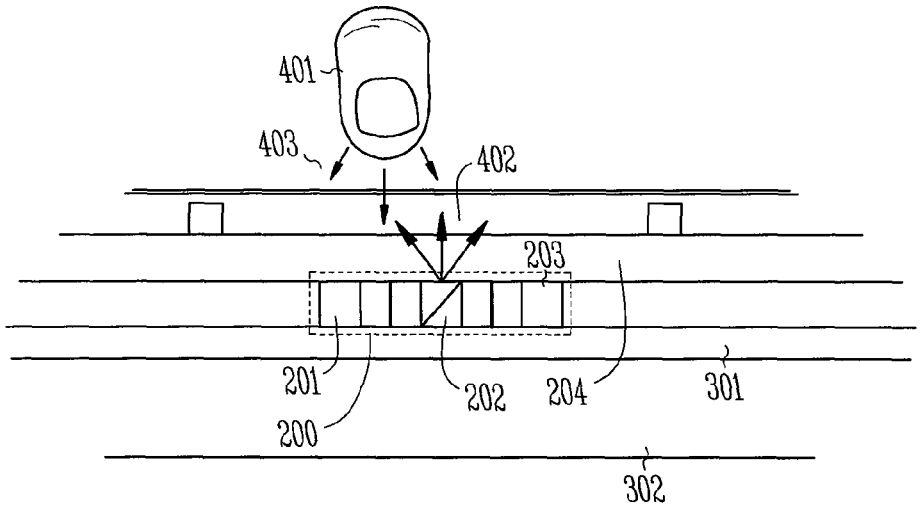
FIG. 6 illustrates a fingertip sensor board according to one embodiment.

FIG. 6 shows an example of a finger 401 approaching the surface 204 near a sensor module 200 corresponding to a relatively large area, such as the area between the nut 106 and the first fret 105A. If a single transmitter 202 and receiver 201 were used, there may still be a signal produced by the phototransistor over the entire range of interest within the fret. However, the signal near the ends of the range may be much smaller than the one in an ideal position over the sensor. For example, if the sensor module 200 were located in the middle of the fret area, the voltage produced by the phototransistor would be greatest in the middle, but may taper off considerably at the extreme ends of the fret area.

This signal reduction may be handled in the software. For example, assuming a "threshold" approach, the threshold could be lowered so that whenever the voltage is above the voltage at the extremes, a valid fretted position is reported. With this method the threshold may also be exceeded when the finger is in the air above the maximum sensor sensitivity position. This may result in a false indication.

The sensor module 200 therefore comprises a first receiver 201 and an additional receiver 203 in order to more accurately detect an approach or press of the surface 204 by a finger 401 or some other object in some embodiments. By using the readings from both receivers 201, a more accurate determination of the fingertip location may be produced. This may reduce the issue of the fingertip above the valid surface creating a reading that is difficult to distinguish from one at the valid ends.

In one embodiment, the software algorithm looks at the reading from one of the receivers 201, and first determines if it is in a range of interest. If so, the second receiver reading is examined to validate that the fingertip is on or near the surface 201. This is possible because the reading of both receivers 201 when the fingertip in the air above the maximum position is different from the set produced when the fingertip is near the extreme end of the range. By looking at a two-dimensional value set, greatly improved accuracy may be obtained.

Figure 13:
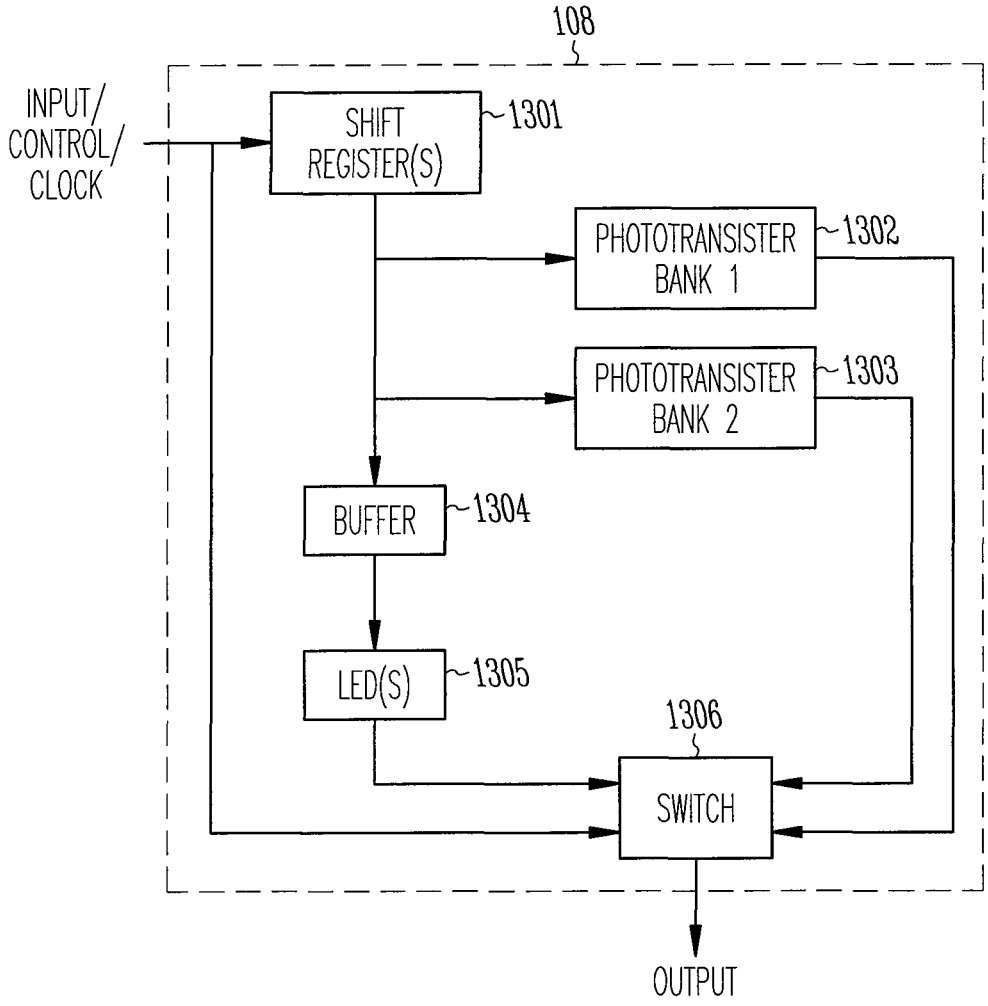
FIG. 13 illustrates a block diagram of certain components of a sensor system according to one embodiment.

FIG. 13 shows a simplified block diagram of a sensor board 108 according to one embodiment. In other embodiments, components of the sensor board 108 may be replaced, omitted, added, or connected differently. The sensor board 108 comprises one or more sensor modules 200 in the embodiment shown, with at least one of the sensor modules 200 comprising multiple transmitters 202.

The sensor board 108 receives control signals, for example from a microcontroller 1200 of a main board 1103. The controls signals may comprise one or more of a data signal, a clock signal, or the like. The control signals are provided to a shift register 1301 in the embodiment shown.

The shift register 1301 may comprise one or more shift registers. The shift register 1301 may comprise a plurality of serial input/parallel output shift register in one embodiment. In certain embodiments, multiple shift registers are chained together by connecting an output of a first register to the input of a second register. A first input of the shift register 1301 may be connected to a data control signal. A clock input of the shift register 1301 may be connected to a clock signal.

The outputs of the shift registers 1301 may be connected to one or more banks of phototransistors 1302 and 1303, and to one or more LEDs 1305 via a buffer 1304. The buffer 1304 provides an operating current to the LEDs 1305. The shift registers 1301 may be connected to the phototransistors 1302 and 1303, and to the LEDs 1305 via multiple wires or lines. For example, each output of the shift registers 1301 may correspond to a sensor module comprising an LED and one or more phototransistors.

The LEDs 1305 and the phototransistor banks 1302 and 1303 are connected to a switch 1306. The switch 1306 is also connected to the input control signal from the microcontroller 1200. In the embodiment shown, the output of the switch 1306 is controlled by the input control signals. The output control switch 1306 may also control the activation of the LEDs 1305.

For example, in operation a clock signal and a data signal may be input to the sensor board 108. The data signal may be input to a data input of the shift registers 1301, and the clock signal may be input to a clock input of the shift registers 1301. The shift registers 1301 may therefore output a high signal on one of the plurality of outputs of the shift register 1301, with the high signal being shifted sequentially through the outputs according to the clock signal. Thus, one of the plurality of outputs may be active at any given time.

The active output is connected to a collector of a phototransistor in at least one of the phototransistor banks 1302 and 1303. The emitter of the phototransistors are connected to the switch 1306, such that when a phototransistor is exposed to light in its operating spectrum and the corresponding output of the shift register 1301 is active, then a high signal will be provided to the switch 1306. Each bank of phototransistors 1302 and 1303 may correspond to different phototransistors located proximate one another in certain embodiments. For example, an output of shift register 1301 may be connected to a first phototransistor in the bank 1302 and a second phototransistor in the bank 1303. The first and second phototransistors may correspond to a single fret position, and by comparing the signals a more accurate determination of a finger location may be determined.

The active output of the shift register 1301 may also be connected to one or more LEDs 1305. The LED connected to the active output may correspond to the same fret position as the first and second phototransistors.

The switch 1306 may then control the activation of the LEDs 1305 and the output from the banks 1302 and 1303. For example, the signals from the phototransistor banks 1302 and 1303 may be output by the switch 1306 according to a cycle determined by a data signal input to the switch 1306 from the microcontroller 1200. The LEDs 1305 may be activated according to a different input such that they are connected to a voltage supply at certain times.

In one embodiment, the switch controls a four phase cycle for each sensor module. In the first phase, a reading is output by the switch 1306 from the first phototransistor bank 1302 with an LED 1305 deactivated by the switch 1306. A reading is therefore output corresponding to the sensor module at a first position with the LED off. The data signal controlling the LEDs 1305 through the switch 1306 may then be activated to turn on the corresponding LED 1305, and the signal from the same bank 1302 may be output. This may provide a reading of a first sensor with the LED on. In the third phase, the clock signal may cycle causing the switch 1306 to output a signal from the second phototransistor bank 1303. The output may correspond to a reading from a second phototransistor of the same finger location or sensor module with an LED on. In the fourth phase, the LED is turned off by the switch 1306 corresponding to the data control signal. The output remains the same such that the second phototransistor is read with the LED off. After the four phases have been read and a serial output provided, the process may repeat for the next output of the shift register 1301. Thus, the process may cycle through each of the sensor modules and provide a serial output to the microcontroller 1200 that corresponds to readings of each phototransistor with the corresponding LEDs both on and off. The output signal may be de-multiplexed by the microcontroller 1200 in order to generate a digital representation of which notes or positions are being played.

Calibration

There are multiple types of calibration that may be used by the guitar 100. The guitar 100 may utilize active calibration using current sensor information, stored calibration using stored data, some combination of current and stored date, or the like.

Active calibration may be an ongoing activity that analyzes, for example, ambient light and legitimate fingertip placement readings. This may become part of an adaptive algorithm that improves the ability to distinguish between false positives and legitimate positions.

Ambient light detection and compensation may take into account the readings of one or more of the sensor modules 200. As described above, a receiver 201 creates a voltage proportional to the light it receives, which may be assumed to be the light emitted by the transmitter 202 and diffused through the fingertip. However, in settings where there is a high amount of ambient light, a voltage may also be produced by the receiver 201 without a finger press and could be confused with a valid fingertip reading.

In this case of high ambient light, placing a fingertip over the sensor may actually block the ambient light. This is because the fingertip diffusion method discussed above may not be as effective unless the source of emitted light is in close proximity to the fingertip. Room lighting, for example, will not appreciably penetrate the fingertip and is blocked with the fingertip over the sensor.

To distinguish between ambient light and diffused light from the fingertip, the transmitter 202 is strobed and two readings can be taken. Initially, with the transmitter 202 off, the receiver 201 is read. Any voltage at that point is known to be caused by ambient light. In one embodiment, if there is a minimal reading by the sensor module 200 when the transmitter 202 is off, then there is a relatively low level of ambient light. In this case, the microprocessor may be configured to use a standard fingertip detection method, such as the methods described above or a variation thereof.

If there is a moderate to high reading by the sensor module 200 when the transmitter 202 is off, then there may be a relatively high level of ambient light. In this case a fingertip in a valid position may block the ambient light, resulting in a reduced reading. In one embodiment, the processor may be configured such that when the instrument 100 is determined to be in a high ambient light environment, a finger press will be recognized when the reading drops below a threshold voltage. In some embodiments, the finger press may then be validated. The finger press may be validated by strobing the transmitter 202 on while reading the response by the receiver 201. If a finger is present and blocking the ambient light, then it should also diffuse some of the light emitted by the transmitter 202. In the case that the reading by the receiver 201 increases above the normal or low ambient light threshold, then the finger may be in a valid position. When the reading by the receiver 201 does not increase above the normal threshold, then it may be determined that there has not been a finger press.

When an array of sensor modules 200 are used on the fret board 109, the readings from the other sensor modules 200 can also be taken into consideration. Since it can be assumed that the fingertips can not cover all of the sensor modules 200, correlating the current sensor information with that of others can help to refine the decision about fingertip placement in high ambient-light areas.

Active calibration may also react to changing conditions such as battery voltage changes, changes in the condition of the surface 204, or the like. Readings taken with the transmitter 202 on and without a fingertip near the fret board can be compared to the initial stored calibration values to determine if, for example, the voltage has changed, the surface is scratched or dirty, or the like. This ongoing calibration can be done initially at power up. An instruction may be given to the user to make sure no fingertips are near the fret board 109 in some embodiments. In this way, changes such as surface scratching can be taken into account in the algorithm.

Stored calibration processes may be used to account for manufacturing tolerances in some embodiments. In addition, it can be used to account for variations in individual players or playing styles. Initial stored calibration may be done at the factory, but a provision can be made for players to tailor the calibration to their own needs in some embodiments.

A stored calibration process may scan the sensor modules and create a table of baseline values. It is assumed during this process that no fingertips are present, so the values read from each sensor when the transmitters 202 are activated represent the reflection that is present in the assembly. These values may be stored in a table inside the microprocessor, for example in a non-volatile memory. A fingertip detection algorithm, such as certain methods discussed above, may examine the difference between the baseline reading and a current reading when making the determination about whether a fingertip is present.

Another form of stored calibration may be used for tailoring the sensors to the fingertips or style of playing of the user. For example, a beginner might choose to calibrate the system in such a way that just resting a finger lightly on the string above the desired fret will register a fretted position, while an advance player may wish to require full pressure on the string against the fret.

In some embodiments, this form of calibration may be activated at any time by the user. For example, it may be activated through a specific sequence of button-presses upon power-up. The player may then place the fingertips in a valid position, and the readings may be recorded and stored in memory for later comparison. In some embodiments, the user may run his or her fingertip down the string across the valid fret positions. A series of values may then be stored for later comparison. In another embodiment, a single fret or position can be selected and an "entry" switch activated to store the value for that single fret or position. An entry could be made by plucking a string or by pressing a switch.

To refine the decision about legitimate fingertip placement, the history of "note confirmation" can be taken into account. In the case of a guitar 100, this confirmation takes place when a string is plucked. If, during the course of play, a false note error occurs, means may be provided for the user to indicate this, so that the error condition can be avoided in the future.

In addition, multiple readings can be stored as the fingertip approaches the sensors in order to aid calibration. This may create a short-term history of the fingertip position as it approaches the sensor. When the fingertip contacts the surface, there may be a distinct change in the received readings that can be used to detect a finger press without use of an 'entry' switch or the like. For example, an increasing voltage level over a period of time may be determined to be a fingertip approaching the fret by the microcontroller. In some embodiments, this voltage may reach a maximum value when the fingertip contacts the surface.

Expression Capture

Since the sensor system described above is analog in nature and a wide range of readings over a relatively large distance are available, existing and new forms of expression can be captured. Vibrato on a conventional guitar, for example, can be produced by rapidly moving the fingertip up and down. This subtly changes the frequency of vibration of a string. As discussed, existing MIDI guitars that employ frequency analysis techniques do not work well for capturing vibrato, since the time taken for the analysis makes the granularity of the vibrato reading too large to be effective. Using the sensors described, however, extremely fast readings can be taken so that effective vibrato can be accurately captured.

Assuming a guitar 100 that has sensor modules 200 populating the fret positions of multiple strings 104, string bending can also be captured. This can be done by taking into account the readings of the sensor modules 200 that are in the same fret position but on adjacent strings 104. For example, moving a first string 104A inward from the first string position towards a second string position will cause a gradual decrease in the reading from the first string sensor module 200 in conjunction with a gradual increase in the reading of the second string sensor module 200. This data can be used to project accurate string bend information.

"Hammer-ons" and "pull-offs" are easily read with the sensor method since a history of the notes fretted is easily maintained. These expressions can be difficult to capture in analog-to-digital systems because very little in the way of note volume is produced with these expressions, and the volume may be below the threshold of being registered.

In addition to these traditional forms of expression, new and novel forms of expression that have not been possible in a stringed instrument such as a guitar can be produced using the sensor system. For example, "aftertouch" is a common MIDI expression parameter used in electronic musical keyboards. This consists of modulating some parameter of the sound after the key is pressed by continuing to apply pressure down on the key after the initial note is played. With the sensor system described here, it has been found that increasing pressure from the fingertip results in a significant voltage increase that the sensors report. This can be used for aftertouch.

A novel expression capture technique can utilize the readings of a fingertip rising off the fret board after the initiation of the note. This could be done for a limited amount of time and/or distance to influence the sound of the note. The sensors can be set to influence different note positions in different ways, and may be sensitive to small changes in position that do not require the fingertip to stray far from the playing surface so that rapid sequences of notes can be played.

String Detection

Although the sensor method just described can be used to accurately report fingertip positions, a guitar requires confirmation of a fretted note via plucking or strumming a string before it is heard. The note volume varies by striking the string with more or less force.

Existing analog methods require analyzing the volume of the note along with its frequency to produce a MIDI note parameter. The problems associated with measuring the frequency have been previously described. Measuring the volume may also be very problematic, because the vibrating string includes many overtones and oscillates around more than one axis. This means that the amplitude of the note cannot be read with certainty until some time after the string has been plucked, and even then must be estimated as there are many variables that influence the note waveform, and many causes of interference such as 60 cycle hum and other forms of noise.

The sensor system just described "knows" the fingertip position prior to the string being plucked, so that analyzing the string frequency is not required. Instead, the note can be produced immediately after the string is released.

With a digital guitar that uses the sensor method described previously, string volume can be deduced if the displacement of a string that is stretched can be accurately read. The volume produced when the string is released will be proportional to the distance it was stretched before release. A system is described below for detecting the displacement of a string and determining certain other characteristics such as string bend.

Figure 7:
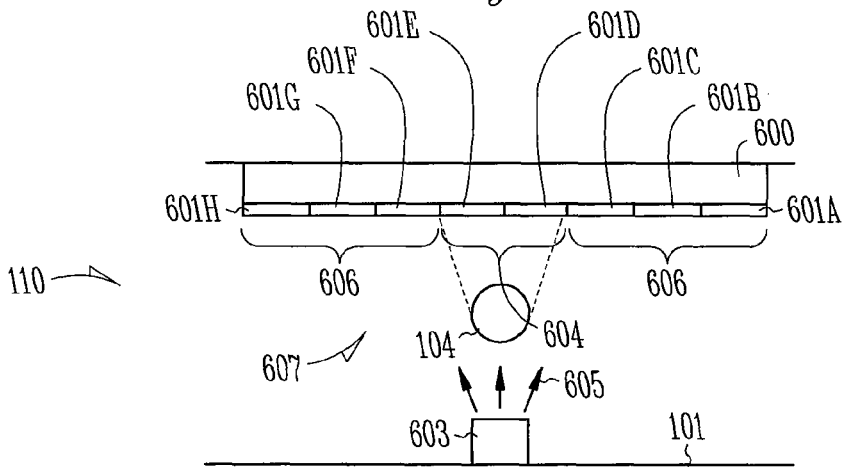
FIG. 7 illustrates a system for detecting string displacement according to one embodiment.

FIG. 7 shows one embodiment of a system 110 for detecting the location of a string 104. In the embodiment shown, the system 110 comprises a light emitting element 603 located on the body 101 of the instrument 100 and directed upwards toward the string 104. The light emitting element 603 may comprise an LED in some embodiments.

The light emitting element 603 is located generally below a resting position 607 of the string 104. In some embodiments, the light emitting element 603 may be located slightly to one side of the resting position 607. In some embodiments in which the light emitting element 603 is located to one side of the resting position 607 of the string 104, the light emitting element 603 may be set at an angle such that the light 605 is generally directed towards the string 104 when the string 104 is in the resting position 607.

The system 110 further comprises an array 600 comprising a plurality of photosensitive elements 601A-H in the example shown. The array 600 is located in a position facing down over the strings so as to reduce ambient light readings in the embodiment shown. The arrangement of the array 600, the light emitting element 603, and the string 104 ideally produce a string shadow on the array 600. In some embodiments, the array 600 comprises a linear array of photoelectric light sensors in a charge-coupled device (CCD). While eight photosensitive elements 601A-H are shown, any number may be used in other embodiments. For example, the array 600 may comprise 768 photosensitive elements in some embodiments.

Light 605 is emitted by the light emitting element 603 and is directed generally towards the resting location 607 of the string 104. Some of that light is obstructed by the string 104, which is located at the resting location 607 in the example shown. Those photosensitive elements 601 that are unobstructed by the string 104 detect a relatively large amount of the light 605, and in turn generate a relatively large current. These photosensitive elements 601 are identified in FIG. 7 as the subset 606. Another subset 604 is identified in FIG. 7 and comprises the photosensitive elements 601 that are obstructed by the string 104. The shadow of the string creates a significant dip in the readings of the obstructed subset 604 of photosensitive elements 601.

Figure 8:
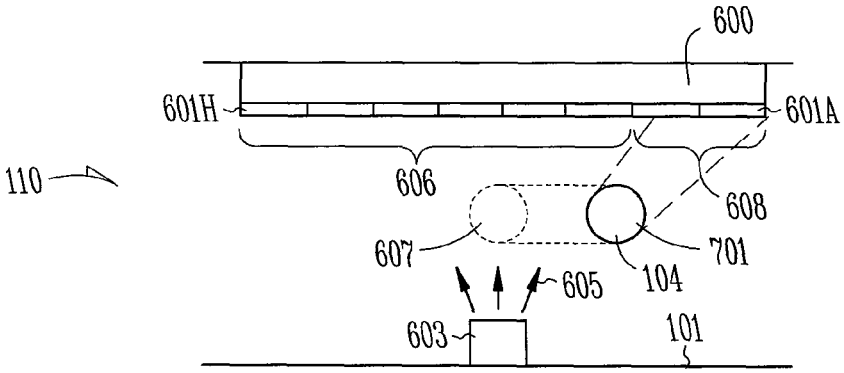
FIG. 8 illustrates a system for detecting string displacement according to one embodiment.

FIG. 8 shows an example of the system 110 when the string 104 has been moved from a rest position 607 to a new position 701. In the new position 701, the string 104 obstructs a different subset 608 of the photosensitive elements 601 from the light emitting source 603. By comparing the signal output by the array 600 when the string 104 is in the new position 701 to the signal when the string 104 is in the resting position 607, it can be determined that the string 104 has been or is being played. Furthermore, the subset 604 of obstructed photosensitive elements may be determined and used to approximate the new position 701 of the string 104. Knowing the position of the string 104 over time may be useful in determining a volume of a note being played or other characteristics. For example, when a string 104 is played or vibrating the farthest edge of the string's displacement may be detected and may be proportional to the volume of the note being played.

Figure 9:
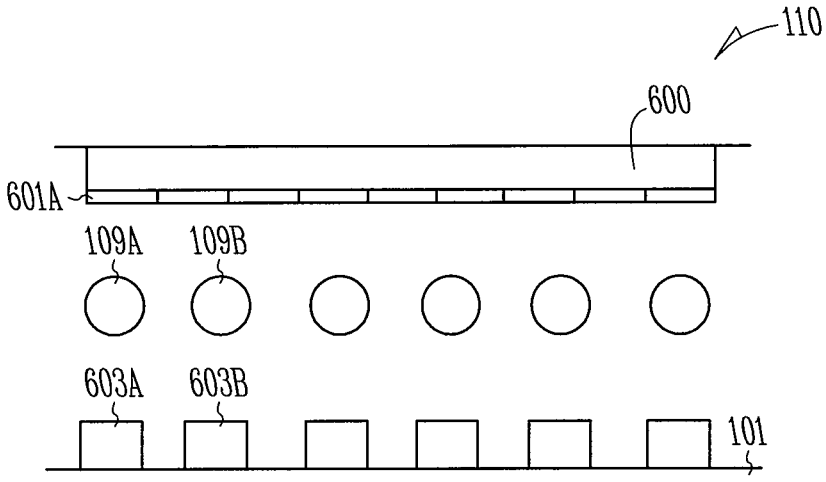
FIG. 9 illustrates a system for detecting string displacement according to one embodiment.

FIG. 9 shows a system 110 according to one embodiment. In the example shown, multiple light emitting elements 603A-F are used, with each light emitting element 603A-F corresponding to a string 104A-F. An array 600 is located opposite the light emitting elements 603A-F, with the strings 104A-F generally between the light emitting elements 603 and the array 600.

The system 110 shown in FIG. 9 may operate similarly to the system 110 shown in FIGS. 6 and 7. In some embodiments, more or fewer light emitting elements 603 may be used. In some embodiments, the light emitting elements 603 are activated simultaneously, and six shadowed or obstructed regions are measured in the signal generated by the array 600. In a preferred embodiment, each of the light emitting elements 603A-F is activated in turn. This may advantageously create a more distinct obstructed region of the array 600. For example, the light emitting element 603A may be activated and the resulting signal generated by the array 600 may be analyzed to determine a location of the string 104A. After that signal has been generated, the light emitting element 603A may be deactivated. The light emitting element 603B may then be activated, and the array 600 may be analyzed to determine the location of the string 104B. This cycle may continue through each of the light emitting elements 603A-F in order to determine the location of each of the strings 104A-F. In some embodiments, the light emitting elements 603A-F are cycled at a frequency higher than that of any likely string vibration. For example, the highest note on a guitar may correspond to approximately 1175 Hz, and according to some embodiments the lights emitting elements 603 and the array 600 may cycle at approximately 8 MHz.

In some embodiments, two or three light emitting elements 603 may be activated at one time without significantly degrading the quality of the signal generated by array 600. For example, the light emitting elements 603A and 603D may be activated at a first time, then the light emitting elements 603B and 603E, followed by the light emitting elements 603C and 603F. In another example, the light emitting elements 603A, 603C, and 603E are activated at a first time, and the light emitting elements 603B, 603D, and 603F are activated at a second time. In some embodiments, one light emitting element 603 may be activated and the resulting signal generated by the array 600 may be used to determine the positions of two or more strings 104.

Figure 10:
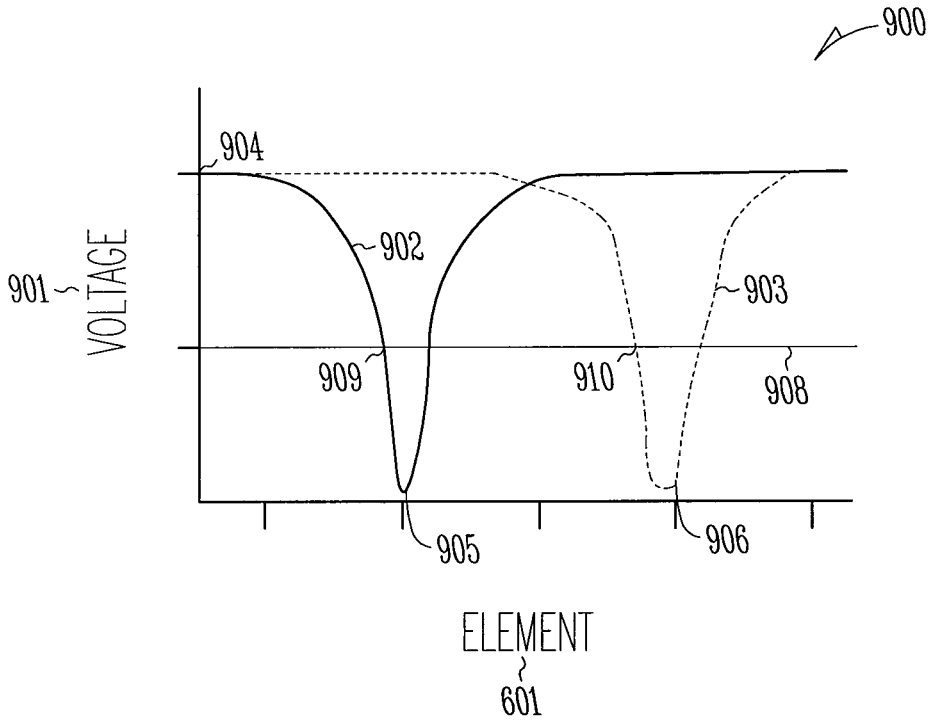
FIG. 10 illustrates a signal generated by a system for detecting string displacement according to one embodiment.

FIG. 10 shows a graph 900 of two signals 902 and 903 generated by the array 600 of photosensitive elements 601. The graph 900 shows the voltage level 901 of the signals 902 and 903 for each photosensitive element 601.

In the example shown, the signal 902 represents a signal generated by the array 600 when the string 104 is in a resting position 607. Many of the photosensitive elements 601 detect light from the light emitting elements 603 without obstruction. These photosensitive elements 601 generate a relatively high current, which is measured across a known resistance and produces a high voltage level 904 shown in the graph 900. In some embodiments, the high voltage level is approximately 5.0 V. The obstructed elements correspond to a lower voltage. In some embodiments, a minimum voltage 905 for the signal 902 is at or near 0.0 V. In other embodiments, the minimum voltage 905 is approximately 2.5 V or some other voltage.

When the string 104 is moved from the resting position 607, a new signal 903 is generated corresponding to the new position. For example, the string 104 may have been moved in one direction, and the signal 903 may therefore have a new minimum 906 corresponding to a different photosensitive element 601. The photosensitive element 601, or a number of photosensitive elements 601 having a voltage 901 below a threshold value 908 may be considered part of the subset 604 that is obstructed by the string 104. Based on the photosensitive elements 601 in that subset, the new location of the string 104 may be estimated. For example, the system 110 may utilize an edge detection algorithm whereby the leftmost photosensitive element 601 in the subset 604 is used to approximate a location of the string 104. While in some embodiments the array 600 is accurate enough to determine a physical location or offset of the string 104, it may be unnecessary in determining the volume of a note being played. For example, the number of photosensitive elements 601 by which an edge of a shadow is offset from the rest position may be used directly to determine the volume, rather than first calculating a physical offset. For example, a table may be stored in the memory correlating detected values to volume levels.

Figure 11:
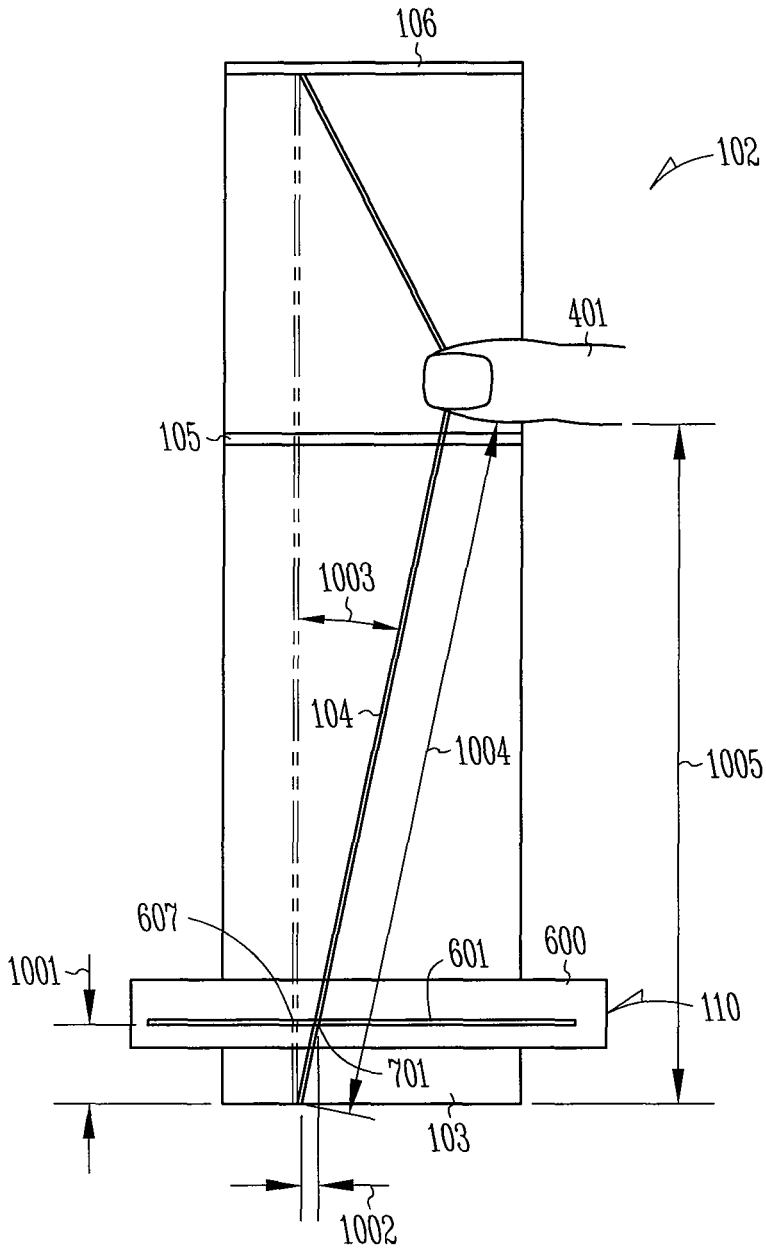
FIG. 11 illustrates a method for determining string bending using a system for detecting string displacement according to one embodiment.

FIG. 11 illustrates a novel method of detecting string bending using a system 110 according to an embodiment. The string bending method described here may be used as an alternative or in addition to the methods described with respect to the sensor board above.

In FIG. 11, a simplified representation of a neck 102 of a guitar is shown, along with a system 110 as described with reference to FIGS. 6 through 9. A string 104 is shown held in place at one end by the nut 106 and at the other end by the bridge 103. A fret 105 is shown, and a finger 401 is shown depressing and bending the string 104 at the fret 105. A dashed line is shown representing the resting position 607 of the string 104.

The string 104 runs generally in a first direction along the neck 102 when in a resting position 607. The system 110 comprises an array 600, the array 600 comprising a plurality of photosensitive elements 601 oriented in a second direction essentially orthogonal to the first direction of the string. The Array 600 may detect the position of the string 104 as described above or by some variation thereof.

A resting position 607 where the string 104 intersects the array 600 is known based on calibrated values. When the string 104 is bent by the finger 401 or some other object, the string 104 intersects the array 601) at a new location 701. The new location 701 is offset in the second direction by an offset amount 1002. The bend shown in FIG. 11 is not to scale. A significant bend has been shown in order to more clearly explain bend detection according to certain embodiments. In various embodiments, string bending may comprise any amount of bending of the string 104, whether by pushing or pulling the string.

The calculated offset distance 1002 is utilized with a known distance 1001 in order to calculate an angle 1003. The known distance 1001 comprises the distance in the first direction from the point where the vibration of the string 104 is substantially anchored to the point where the string 104 crosses the array 600. The distance 1005 from the bridge 103 to the fret 105 is known when the fret position pressed by the finger 401 or some other object is known, for example when determined by a sensor board 108. A new relative string length 1004 is calculated using the angle 1003 and the fret length 1005. A frequency corresponding to the new string length 1004 is determined and a signal may be output corresponding to that frequency or an output signal may be modified to indicate the presence and/or the magnitude of bending. In other embodiments, a table may exist in the memory that directly correlates the offset of the center of vibration, in terms of the number of photosensitive elements 601, from the resting location with a value indicative of an amount of bend or an amount to modify a note.

Since this method does not require frequency analysis, very detailed and high-speed readings can be taken and used to influence the pitch of the note appropriately. The inherent analysis time of frequency methods precludes rapid string-bend measurements, and is subject to "tracking errors" since the frequency of a bent string rapidly changes. The method described advantageously eliminates this as an issue and results in an accurate reading of string bending across all strings according to some embodiments.

Another method for detecting string offset or plucking is an analog method that performs an analog-to-digital conversion and analyzes the data produced when a string is plucked. While the signal used, which may be the signals generated by standard electric guitar pickups or the like, is similar to signals used in methods currently employed, the task of determining when to initiate a note is simplified since frequency analysis is not required. For example, when starting from a string at rest, the fact that a signal becomes present is enough to indicate that a string has been plucked and a note code can be sent out. Thus, according to some embodiments, this method may be able to detect a string that has been picked without waiting for the string vibrations to subside to a rest position state. In a prototype guitar, it was observed that the waveform produced through various methods of picking the string produce characteristic signals that can be detected by a microcontroller algorithm. For example, if a string has been plucked and, before it comes to rest, is plucked again, for a short period of time the string will cease vibration and then resume with the new pick. This interruption of vibration may be about 10 milliseconds. This gap can be measured and taken into account when deciding when a new pick event has occurred.

According to some embodiments, the processor analyzes the incoming waveform in discrete slices of time and implements a state machine to deduce the string state. A rest position is easily detected, after which a positive or negative voltage increase is taken to mean a string that was picked. In some embodiments the processor detects an excursion of the waveform in one direction, followed by an excursion in another direction within an appropriate amount of time in order to prevent false readings, for example from tapping the body of the guitar. Further analysis may be done in discrete time segments after this initial event to decide when a note should be ended, or when a string was re-picked.

Game Controller

According to certain embodiments, the musical instrument described herein may be used as a wireless or wired game controller. For example, a wireless transmitter may be provided to output the digital codes produced by the microcontroller of the guitar. The digital codes may correspond to a wireless interface and control scheme utilized by a gaming or other computer system. In other embodiments, a wired connection may be utilized to provide the digital codes or signals to a gaming system. For example, a wired connection might be achieved utilizing a standard ¼ inch TS connector. In other examples, a ¼ inch stereo IRS connector is used with one signal line being dedicated to the digital codes or signals.

In certain embodiments, a switch is provided to switch between output modes. For example, a standard 5-position blade switch may be wired such that one position corresponds to a wireless output mode for a computer game, in some embodiments, the other positions of the switch may be utilized to select one or more sets of pickups.

In some embodiments, the strings may be removed. For example, utilizing a non-contact sensor such as certain embodiments of the sensor board described above, the user's finger locations may be detected without the use of strings. In some embodiments, the paddle or other switch may be utilized to mimic the strumming of the strings and to generate a signal indicative of playing a note or chord.

Certain embodiments of a game controller according to the above systems and methods provide a number of advantages. For example, unlike typical musical game controllers that must be used with a computing system, a musical instrument according to some embodiments may be used as normal and in addition with a computing system. For example, an analog output may be provided to a guitar amplifier or a digital output may be provided to a video game system. In some embodiments, a user may play a game or use a computer learning system to practice realistic playing. For example, common video game guitar controllers utilize five buttons spaced evenly to mimic fret positions. According to certain embodiments, a user may play a game with positions spaced according to an actual guitar, which may translate into an increased ability to play the guitar. Additionally, a user may learn and practice finger locations corresponding to actual or common chords used for playing an instrument such as a guitar, whereas with common game controllers multiple simultaneous button presses do not correspond to musical chords. According to certain embodiments, the sensor system described herein may mimic the size and feel of a musical instrument. Thus, the user may also learn to maneuver his or her fingers across the playing surface based on touch and memory. Other advantages may be realized according to varying embodiments, including advantages not mentioned here. Additionally, certain embodiments may not utilize every advantage described herein.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown and described. However, the present inventors also contemplate examples in which only those elements shown and described are provided.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, the code may be tangibly stored on one or more volatile or non-volatile computer-readable media during execution or at other times. These computer-readable media may include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

What is claimed is:

1. A computing device accessory comprising:

a body including a neck portion;

a plurality of analog sensor modules distributed along the neck portion, each analog sensor module including an infrared (IR) transceiver and generating a signal when a finger is at a location proximate the location on the neck portion corresponding to each analog sensor module;

a processing module generating an output signal based at least in part on signals received from the plurality of analog sensor modules; and an output module transmitting the output signal to an external computing device.

2. The computing device accessory of claim 1, further comprising a plurality of strings running across a central portion of the body and along a length of the neck portion.

3. The computing device accessory of claim 2, wherein the plurality of analog sensor modules are positioned under the plurality of strings and distributed along the length of the neck portion.

4. The computing device accessory of claim 1, wherein the signal generated by each analog sensor module of the plurality of analog sensor modules can be interpreted by the processing module to capture a musical expression.

5. The computing device accessory of claim 4, wherein the processing module interprets the signal generated by each analog sensor module to generate an output signal representing a musical expression selected from the following group of musical expressions:

vibrato;

hammer-ons;

pull-offs;

aftertouch; and string bend.

6. The computing device accessory of claim 1, wherein the signal generated by each of the analog sensor modules of the plurality of analog sensor modules varies non-linearly based on the proximity of the finger.

7. The computing device accessory of claim 1, wherein the neck portion is divided into a plurality of regions, the plurality of regions separated by frets.

8. The computing device accessory of claim 7, wherein the plurality of analog sensor modules are distributed along the neck portion in locations that substantially correspond to figure locations on a guitar, the figure locations corresponding to notes or chords.

9. The computing device accessory of claim 1, wherein the output module transmits the output signal over a wireless network protocol to the external computing device.

10. The computing device accessory of claim 1, wherein the processing module formats the output signal to conform to a musical instrument digital interface (MIDI) protocol.

11. A method comprising:

sensing, on a computing device accessory including a body with a neck portion, a proximity of a finger to a surface of the neck portion, the computer device accessory including at least one analog sensor module embedded in the surface, wherein the analog sensor module transmits infrared (IR) light generally towards the finger and receives IR light from the finger;

producing, using the at least one analog sensor module, a signal, the signal based at least in part on the proximity of the finger to the surface;

receiving, with at least one processor, an event to trigger generation of an output signal;

generating, using the at least one processor, the output signal based at least in part on the signal generated based on the sensed proximity of the finger; and transmitting the output signal to an external computing device.

12. The method of claim 11, wherein the receiving the event includes receiving parameters characterizing the event; and wherein the generating the output signal is further based on the parameters characterizing the event.

13. The method of claim 11, herein the receiving IR light from the finger includes IR light suffused by the finger.

14. The method of claim 13, wherein the generating the signal includes generating a signal that varies non-linearly based on the proximity of the finger to the surface.

15. The method of claim 14, wherein the generating the signal includes producing a maximum signal value when the finger is pressed against the surface.

16. The method of claim 11, wherein the generating the output signal includes interpreting the signal to capture a musical expression.

17. The method of claim 11, wherein the transmitting the output signal includes transmitting over a wireless network protocol.

18. An apparatus comprising:

a body including a neck portion;

a plurality of analog sensor modules distributed along the neck portion, each analog sensor module generating a non-linear signal based on a proximity of an object to a surface of the neck portion corresponding to each analog sensor module;

a processing module including at least one processor, the processing module generating an output signal based at least in part on signals received from the plurality of analog sensor modules; and an output module wirelessly transmitting the output signal to an external computing device, the output signal conforming to a musical instrument digital interface (MIDI) protocol.

* * * * *